United States Patent [19]

Sussman

[11] 4,321,935

[45] Mar. 30, 1982

[54] FINGERNAIL-POLISHING ARTICLE OF MANUFACTURE

[76] Inventor: Howard Sussman, c/o F. F. Adams Inc., 700 NW. 8th Ave., Fort Lauderdale, Fla. 33311

[21] Appl. No.: 245,142

[22] Filed: Mar. 18, 1981

[51] Int. Cl.[3] ..... A45D 29/00

[52] U.S. Cl. ..... 132/73

[58] Field of Search ..... 13/73, 73.5, 75; 206/12

[56] References Cited

U.S. PATENT DOCUMENTS 2,219,597 10/1940 Lutz ..... 132/73 X 2,842,141 7/1958 Rodriques, Jr. ..... 132/73.5

3,369,553 2/1968 Keesee ..... 132/73.5

3,478,763 11/1969 Weinstein ..... 132/75

*Primary Examiner*—G. E. McNeill

*Attorney, Agent, or Firm*—Bauer & Amer

[57] ABSTRACT

A convenience article of manufacture intended to enable the polishing of fingernails without third party assistance, in which a tiltable bottle of nail polish is supported on a rotatable cam which in response to selective rotation sets the bottle at an appropriate angular orientation for facilitated removal of the viscous nail polish therefrom.

5 Claims, 12 Drawing Figures

FINGERNAIL-POLISHING ARTICLE OF MANUFACTURE

The present invention relates to a nail-polishing do-it-yourself type convenience article of manufacture, and more particularly to a simply constructed, yet effective, bottle-tilting means thereof and an associated universally movable finger rest or support. Thus, the movement of the bottle tilt enables the remaining volume of the polish to be collected in the bottom of the bottle incident to facilitated removal therefrom, while the movement of the finger rest enables proper positioning of the fingernails receiving the polish.

To enable a woman, without assistance, to polish her own fingernails requires for most an assisting device since removal of the viscous nail polish from the supply bottle thereof becomes difficult as the supply is diminished, and brushing application of the polish requires accurate placement on the fingernail surfaces. To achieve both these objectives, the convenience device must thus allow for movement (i.e. tilting) of the bottle and also of an appropriate finger rest or support (i.e. in all major degrees of movement). Undoubtedly due to the difficulty of providing a nail-polishing device with the moving parts as noted, and yet characterized by a simple and economic construction, there is not available any satisfactory prior art device. Rather, a stationary or uni-directional movable finger rest is typically provided as exemplified by the device of U.S. Pat. No. 2,171,804, which does not entirely obviate the need for an assisting manicurist.

Broadly, it is an object of the present invention to provide an improved fingernail-polishing device overcoming the foregoing and other shortcomings of the prior art. Specifically, it is an object to provide a device characterized by simplicity of construction, and yet so effective in simplifying the nail-polishing procedure, as to eliminate third party assistance.

A convenience article of manufacture for applying fingernail polish demonstrating objects and advantages of the present invention includes a pivotally mounted fingernail polish bottle holder having a bottom wall presenting a forward edge. Cooperating with the bottle holder is a rotatably mounted cam member having an operative position in supporting contact beneath the forward edge of the bottle holder such that a cam surface on the cam member, in response to selective rotation, is effective to raise and lower the forward edge of the bottle holder. In this way, the bottle holder is urged through a pivotal traverse causing a corresponding angular position in any fingernail polish bottle positioned therein and thus of the fluid contents of said bottle to thereby facilitate the removal of the fingernail polish from the bottle.

A preferred embodiment of the convenience article hereof for do-it-yourself nail-polishing also includes a universally movable finger rest or support, the same consisting of an unattached sphere, a U-shaped member having a central opening disposed in covering relation over the sphere with a portion of the sphere protruding through said opening, and a finger-supporting member operatively connected to the protruding portion of the sphere, whereby the finger-supporting member is adapted to have degrees of movement corresponding to the rotative movements of the sphere.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
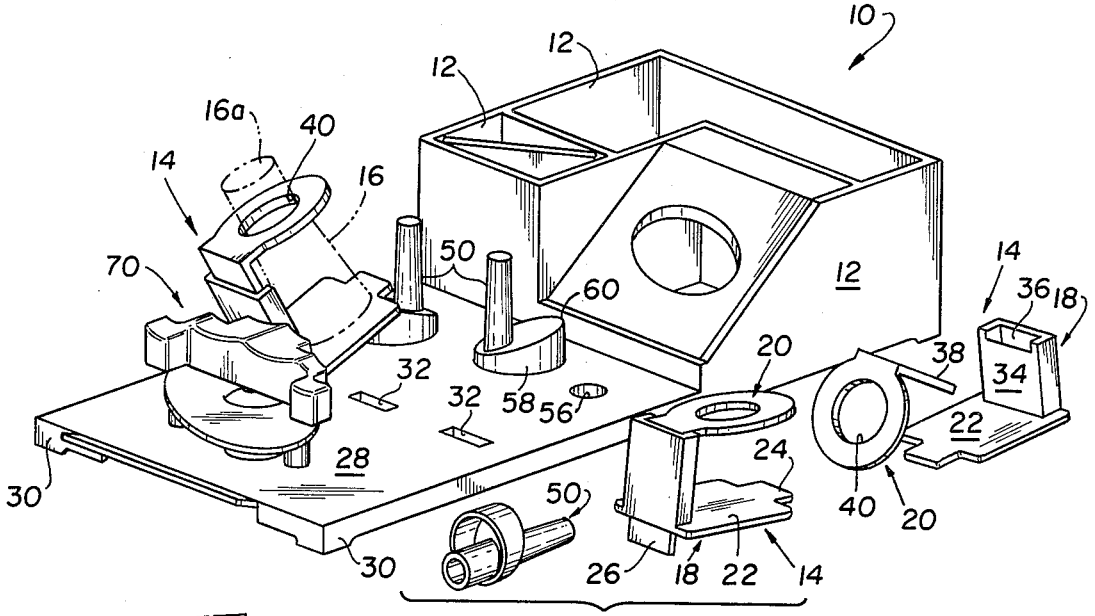
FIG. 1 is a perspective view of an improved fingernail-polishing article of manufacture according to the present invention, in which some of the components thereof are shown in assembled condition and some in unassembled condition to the right of the article as viewed in FIG. 1.

The article of manufacture of the within invention, generally designated 10, is intended to enable a woman to apply fingernail polish to her nails without the assistance of another party. In the preferred commercial embodiment of article 10, a plastic construction material is used and the manufacture thereof is by injection molding. In this way, article 10 is economically manufactured with walls, individually and collectively designated 12, which bound compartments that are appropriately sized and shaped to store cosmetics and sundry items. Of greater importance, however, and contributing to the patentable significance of article 10, is the provision of several stations, three being the preferred number, at each of which a bottle holder, generally designated 14, is stragetically located and enables the user to hold a bottle of fingernail polish, illustrated in phantom perspective in FIG. 1 by the reference numeral 16, in any selected angular orientation. This is significant since due to the viscous nature of fingernail polish, after an initial volume thereof is removed from the bottle 16 it becomes difficult to remove the remaining volume unless the bottle is appropriately tilted. The construction and mode of operation of the bottle holder 14 is effective in enabling the user to achieve any angular tilt or orientation in the fingernail polish bottle 16, all as will now be described in detail.

Each of the three holders 14 for the bottle 16 at the three stations are identically constructed, and each includes two L-shaped members 18 and 20. Member 18 includes a bottom wall 22 having at its forward edge a lifting tab 24, the significance of which will soon be apparent and, at its opposite edge, a depending projection 26. The front of article 10 includes a horizontal base 28 which is formed at a slightly raised or clearance position above a support surface by corner legs 30. Because of the raised clearance position of the base 28 at each of the three stations for the bottle holder 14 there is able to be provided, and there is provided, a rectangular notch 32 into which the depending projection 26 is inserted. In this way, each bottle holder 14 is supported on the base 28 but is allowed a degree of tilting movement to the extent of the clearance that exists in the loose fit that is established between the slightly oversized notch 32 and the depending projection 26. This can be better appreciated by progressive examination of FIGS. 2A, 2B and 2C.

Completing each member 18 of each bottle holder 14 is another leg oriented perpendicularly of the bottom wall 22 and consisting of a cooperating arrangement of walls 34 which cooperate to bound a compartment 36. The other member 20 of the holder 14 has a first leg 38 which is sized to be slidably inserted in the compartment 36 while the other leg thereof is formed as a circle with a bottle neck engaging opening 40 located centrally thereof. Each bottle holder 14 will be understood to initially be in a disassembled condition as illustrated to the right in FIG. 1. A bottle 16 of nail polish is then placed upon the bottom wall 22 after which member 20 is assembled to member 18 by leg 38 being inserted in the compartment 36 and the bottle neck 16A being allowed to protrude through the opening 40. Next each holder 14 is placed at its station which, as already described, is achieved by the insertion of the depending projection 26 in a cooperating one of the notches 32.

The means herein provided to tilt each combination of bottle holder 14 and bottle 16 includes a rotable cam member generally designated 50. The upper body portion 52 of member 50 is easily grasped and turned by the user about a vertical axis which is established by the projection of a lower body portion 54 into a cooperating opening 56 provided in the raised base 28. Connected in an eccentric relation to body portion 52, 53 of each member 50 is a cam 58 which has a peripheral contact surface or edge 60 which is in the nature of a camming surface and has a varying position or elevation with respect to a horizontally oriented reference surface or plane. That is, and using the horizontal base 28 as a reference plane, the peripheral contact edge 60 of cam 58 can be made to assume an elevated position above the reference plane at what can be as little as the nominal height 62 of cam 58, or at the maximum height 64 thereof. To enable effective use to be made of the cam 58 for selective tilting of the bottle holder and bottle 14, 16, the space or distance between opening 56 which defines the vertical rotation axis of the cam member 50 and the slot 32 which defines the tilt axis of the bottle holder 14 is selected so that the camming suface 60 of cam 58 is always in supporting position beneath the forward edge of the bottle holder 14 or, more particularly, the tab 24 thereof, no matter what the position of rotation is of the cam member 50. The relationship just described can be readily understood from the side elevational views of FIGS. 2A–2C, as well as from the corresponding plan views 3A–3C projected therefrom.

Figure 2A:
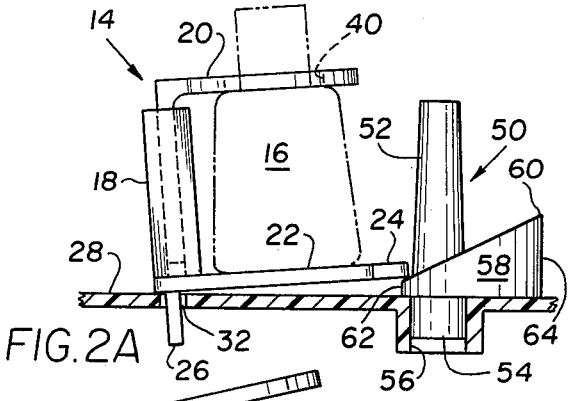
FIGS. 2A, 2B and 2C are related side elevational views in which the holder for a bottle of fingernail polish, shown in phantom perspective in FIG. 2A, is illustrated in varying angular orientations.
Figure 3A:
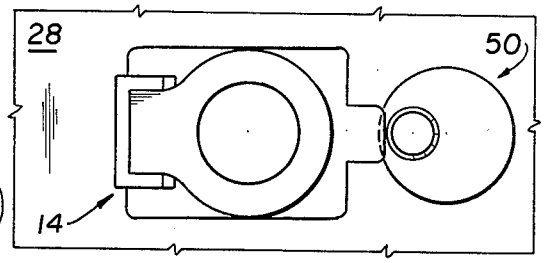
FIGS. 3A, 3B and 3C are plan views showing further structural details of the bottle holder, each being projected from a corresponding side elevational view of FIGS. 2A–2C inclusive.
Figure 2B:
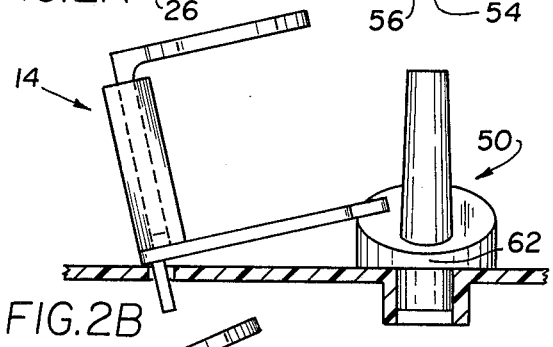

Thus, as may be readily appreciated from the related view of FIGS. 2A and 3A, the typical starting position for a bottle holder 14 appropriately assembled in holding relation about a bottle 16 is that in which there is a minimum tilt and this, of course, would result when the tab 24 is in contact with surface 60 in the vicinity of the minimum height 62 of the cam 58.

Figure 3B:
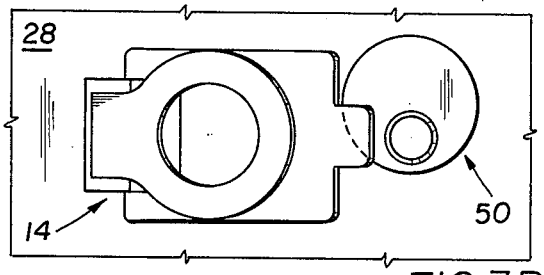

Assuming, however, that the supply of the nail polish in the bottle 16 is significantly diminished, the remaining supply must be collected in a corner of the bottle and thus the bottle should be tilted. As illustrated by the related views of FIGS. 2B and 3B, a moderate tilt can be imparted to the bottle holder 14 by slight rotation of the cam member 50 of a one-quarter turn or the like. This will correspondingly rotate an ascending portion of the camming surface edge 60 beneath the tab 24 and thus lift the bottle holder 14 through a greater angular orientation.

Figure 2C:
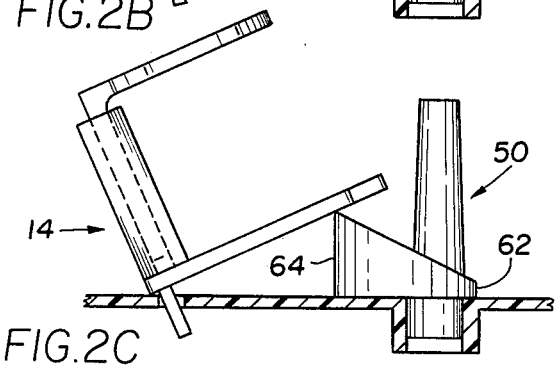
Figure 3C:
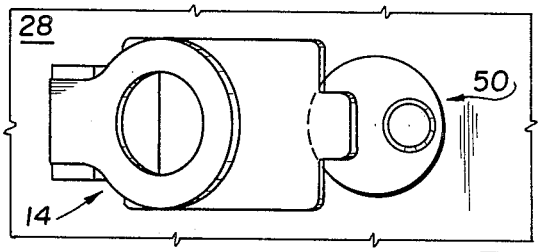
Figure 5:
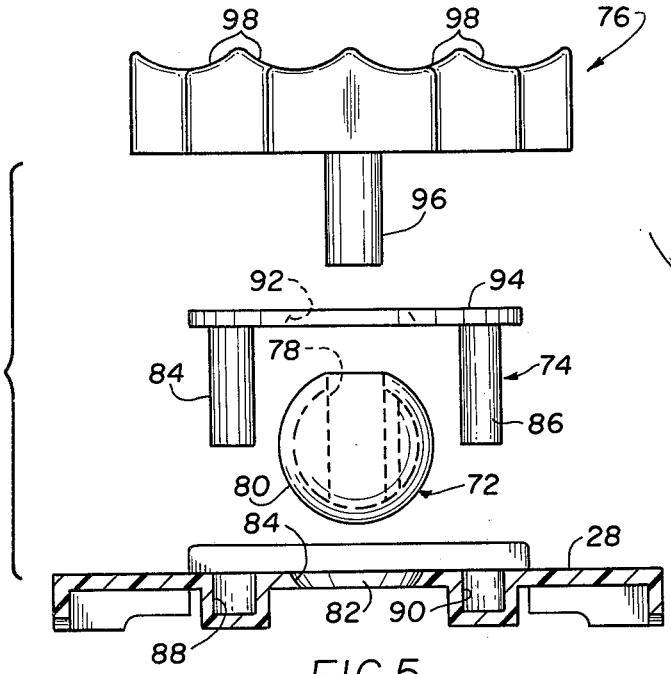
FIG. 5 is a front elevational view of the components in disassembled condition which comprise the finger support of FIG. 4.
Figure 4:
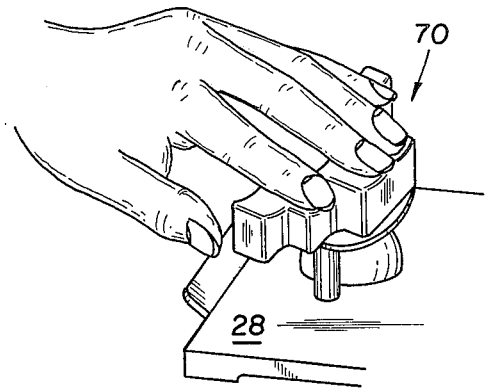
FIG. 4 is a perspective view of a support for the user's fingers, said support being strategically located at the front of the article of FIG. 1.
Figure 6:
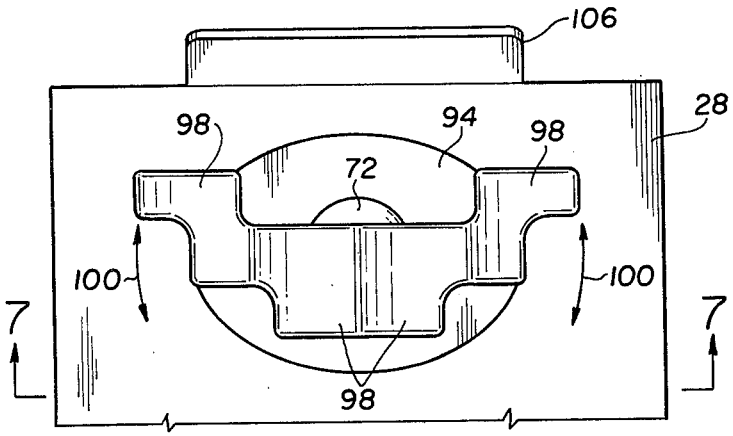
FIG. 6 is a plan view showing further structural details of the finger support.
Figure 7:
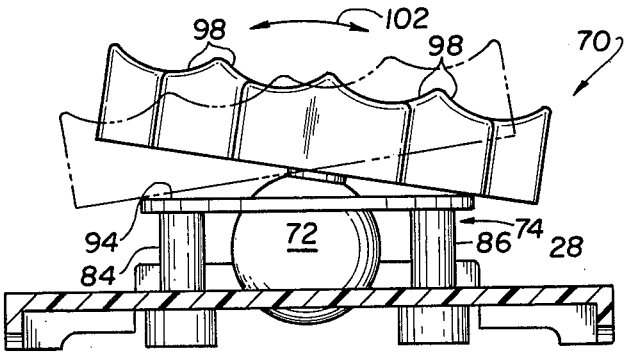
FIG. 7 is a front elevational view, in section, taken along line 7—7 of FIG. 6, showing still further structural details of the finger support and illustrating a degree of movement thereof.
Figure 8:
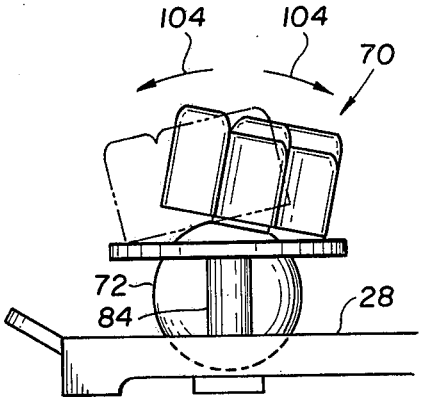
FIG. 8 is a side elevational view of the finger support illustrating further structural details and another degree of movement thereof.

The maximum degree of angular orientation can be imparted to the bottle holder 14 by rotating the cam member 50 so that the highest elevation 64 of the cam 58 supports the bottom wall 22, all as is clearly illustrated in FIGS. 2C, 3C. Thus, in the simple manner and with the simple structural features just described, the user of the convenience article 10 hereof can readily set the bottle of nail polish in a favorable inclined position towards herself that will facilitate removal of the nail polish preparatory to the application thereof to her fingernails.

The other important aspect of applying fingernail polish is of course concerned with proper positioning of the individual fingernails receiving the polish. In accordance with the present invention there is thus provided a multi-directional moving finger rest at a strategic location at the front end of the base 28 of article 10, and thus immediately in front of the locations at which the three bottle holders 14 are located. The referred to strategic location for the finger rest, herein generally designated 70, is shown in FIG. 1 and the specific structural details of a preferred embodiment thereof are shown in FIGS. 4–8, inclusive, to which figures reference is now made. The finger rest or support 70 includes three components, namely a spherical component 72, a retainer or cover 74 for the sphere 72, and finally the support per se, designated 76. Sphere 72 has an assembly opening 78 coincident with the diameter thereof and an external spherical surface 80 which is placed in unattached relation within a slightly undersized opening 82 of the raised base 28, said opening 82 being bounded by a beveled edge 84. As a result of the placement of sphere 72 in the opening 82 and otherwise not restricted by any attachment to the base 28, sphere 72 is of course capable of partaking of rotative movement. However, to prevent sphere 72 from inadvertently popping out of the opening 82, the cover 74 with two depending posts 84 and 86 is disposed in covering relation over the sphere 72 and the lower ends of the posts inserted in appropriately sized openings 88 and 90. The upper portion of sphere 72 confined, as just described, by the cover 74 is adapted to protrude through a central opening 92 in the top connecting panel 94 of cover 74. The slight protrusion of the sphere 72 facilitates, as will next be described, the insertion of a depending projection 96 of the finger support 76 in the opening 78 of sphere 72.

Completing the finger rest or support 76 is a laterally oriented member with appropriate shaped indentations, individually and collectively designated 98, provided in the upper surface thereof. With the exception of the user's thumb, which is naturally oriented 90 degrees of her fingers and is thus permitted to rest on an extending ledge 106, the user will place her four fingers on the movable support 76 with the fingernails thereof specifically located in the immediate vicinity of the indentations 98. As can be readily appreciated from FIGS. 6, 7 and 8, sphere 72 has a degree of movement about a vertical rotation axis, as illustrated by the doubleheaded arrows 100 in FIG. 6, as well as a rocking movement as illustrated by the doublehead arrow 102 of FIG. 7, and also a fore and aft tilting movement as illustrated by the arrow 104 in FIG. 8. In this manner, the finger support 76 of the finger rest portion 70 of article 10 thus provides multi-direction movements 100, 102, and 104, all of which greatly facilitate the application of the fingernail polish by permitting the user to place the surface of the fingernail in the most advantageous position for brushing application of the polish. Following polishing of the four nails in the position of FIG. 4, the user of course then merely places her thumb in an appropriate position on the finger rest 70 to complete the nail-polishing operation.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A convenience article of manufacture for applying fingernail polish comprising a pivotally mounted fingernail polish bottle holder having a bottom wall presenting a forward edge, a rotatably mounted cam member having an operative position in supporting contact beneath said forward edge of said bottle holder, and a cam surface on said cam member at said contact with said bottle holder forward edge effective to raise and lower said forward edge in response to the direction of rotation of said cam member, whereby said bottle holder is urged through a pivotal traverse causing a corresponding angular position in any fingernail polish bottle positioned therein and thus of the fluid contents of said bottle to thereby facilitate the removal of said fingernail polish from said bottle.

2. An article useful for applying fingernail polish as claimed in claim 1 wherein said bottom wall of said bottle holder is one leg of an L-shaped first member, and cooperating therewith is an interfitting second L-shaped member, whereby said bottle is adapted to be placed in an interposed position between said first and second members incident to being angularly tilted along with said bottle holder.

3. An article useful for applying fingernail polish as claimed in claim 2 including a raised base for said article, said raised base having a rectangular slot therein defining the pivotal axis of said bottle holder, and said bottle holder bottom wall having a depending rectangular projection adapted to be inserted into said slot for supporting said bottle holder on said raised base while allowing pivotal movements thereof to the extent of the degree of movement of said projection in said slot.

4. An article useful for applying fingernail polish as claimed in claim 3 including a universally movable support for the fingers of the user of said article, said support being mounted on said raised base in close proximity to said bottle holder, to thereby facilitate the application of polish from said bottle upon the user's fingernails.

5. The universally movable support for a nail-polishing article of manufacture as claimed in claim 4 comprising an unattached sphere, a U-shaped member having a central opening disposed in covering relation over said sphere with a portion of said sphere protruding through said opening, said member being effective to maintain said sphere in position thereunder while permitting rotative movements in said sphere, and a finger-supporting member operatively connected to said protruding portion of said sphere, whereby said finger-supporting member is adapted to have degrees of movement corresponding to said rotative movements of said sphere.

* * * * *